United States Patent [19]

Perina

[11] 4,271,566

[45] Jun. 9, 1981

[54] SHEAR ATTACHMENTS USING HOOK AND LOOP FASTENER ELEMENTS

[75] Inventor: Joseph Perina, Huntington, N.Y.

[73] Assignee: Velcro USA Inc., New York, N.Y.

[21] Appl. No.: 45,082

[22] Filed: Jun. 4, 1979

Related U.S. Application Data

[63] Continuation of Ser. No. 750,002, Dec. 13, 1976, which is a continuation of Ser. No. 151,744, Jun. 10, 1971.

[51] Int. Cl.[3] ..... A44B 17/00; E05C 21/02

[52] U.S. Cl. ..... 24/204; 24/DIG. 11; 24/306; 2/DIG. 6; 49/465; 160/180; 160/354; 297/DIG. 6

[58] Field of Search ..... 24/204, DIG. 11, 73 VA, 24/31 V; 312/263, 213; 2/DIG. 6, 2; 297/DIG. 6; 160/180, 354; 49/463, 465

[56] References Cited

U.S. PATENT DOCUMENTS

| | | | |
|---|---|---|---|
| 1,638,073 | 8/1927 | Van Heusen | 24/204 |
| 2,728,480 | 12/1955 | Close | 312/263 |
| 3,176,364 | 4/1965 | Dritz | 24/204 |
| 3,192,306 | 6/1965 | Skonnord | 312/213 |
| 3,251,399 | 5/1966 | Grossman | 160/180 |
| 3,413,656 | 12/1968 | Vogliano et al. | 2/2 |
| 3,475,810 | 11/1969 | Mates | 24/204 |
| 3,491,486 | 1/1970 | Caruth | 49/463 |
| 3,512,318 | 5/1970 | Turner | 52/100 |
| 3,668,808 | 6/1972 | Perina | 49/465 |
| 3,745,709 | 7/1973 | Perina | 49/465 |

*Primary Examiner*—Victor N. Sakran
*Attorney, Agent, or Firm*—Pennie & Edmonds

[57] ABSTRACT

Various attachments are disclosed employing hook and loop fasteners which are confined in a manner to permit engagement and disengagement only in a shear direction.

13 Claims, 13 Drawing Figures

FIG. 1
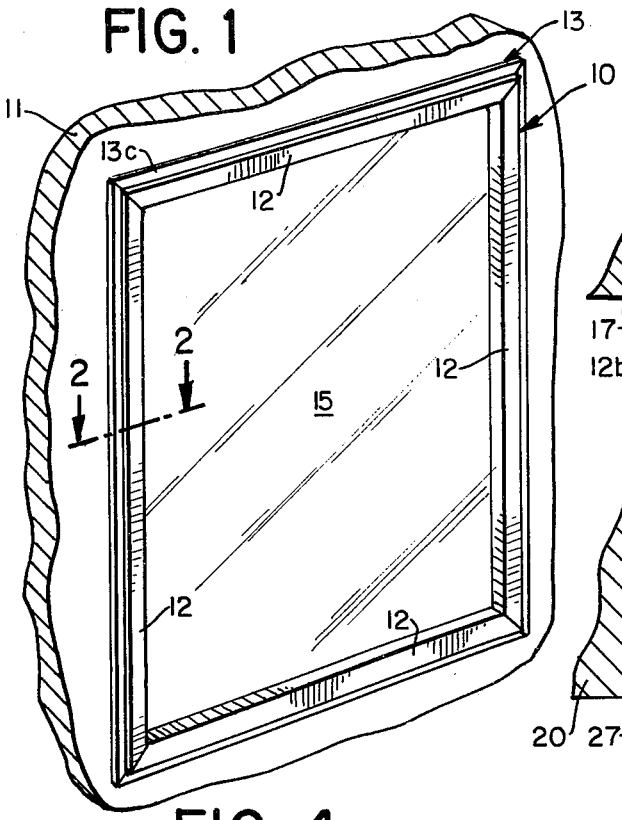
FIG. 2
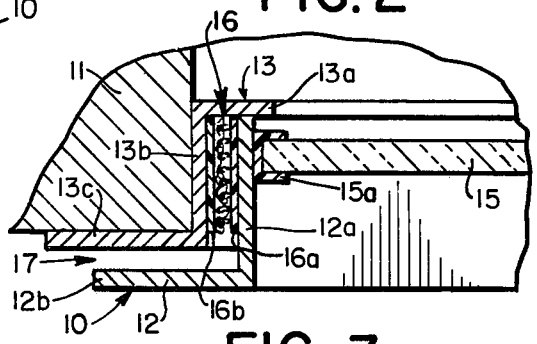
FIG. 3
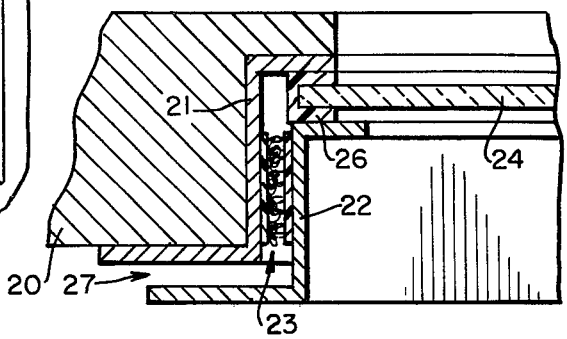
FIG. 4
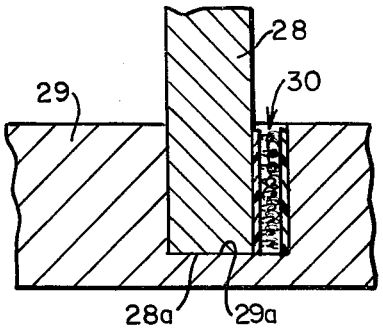
FIG. 5
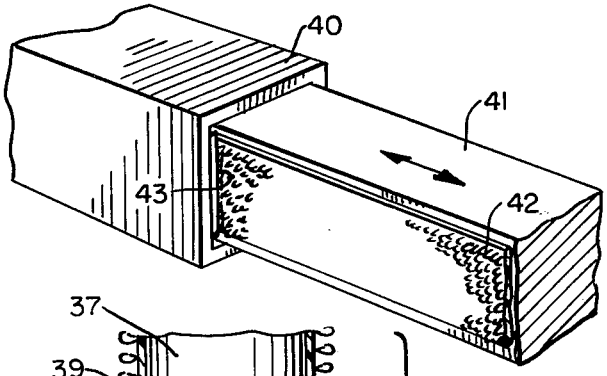
FIG. 6
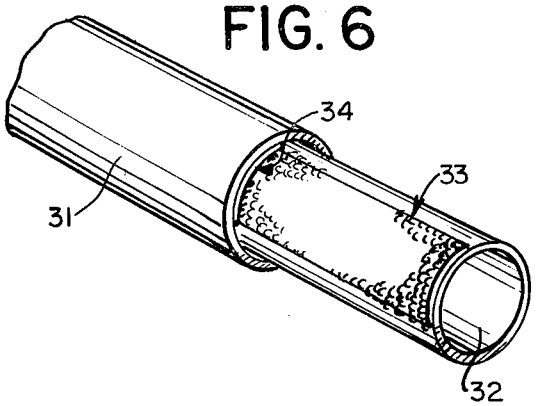
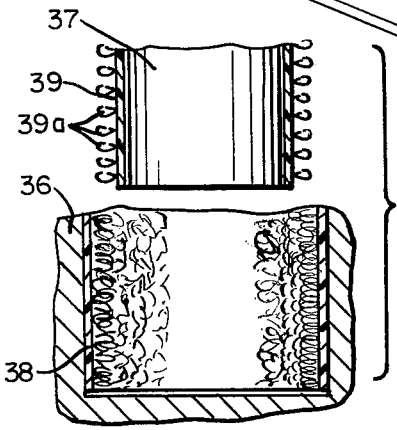
FIG. 7

SHEAR ATTACHMENTS USING HOOK AND LOOP FASTENER ELEMENTS

This is a continuation of application Ser. No. 750,002 filed Dec. 13, 1976, which is a continuation of application Ser. No. 151,744, filed June 10, 1971.

BACKGROUND OF THE INVENTION

Hook and loop fasteners have a variety of uses. Initially, such fasteners were used as fabric-to-fabric connectors. Fasteners of this type have found additional usefulness as closures of various types and as quick connection and disconnection means for objects such as wall panels, pictures etc. In all of the many known applications for hook and loop fasteners, the conventional manner used in fastening is to press the mating hook and loop elements firmly into face-to-face engagement (parallel to the upstanding hooks and loops) and to separate these elements by progressively peeling one from the other. By so doing, the bond of hook-to-loop is gradually broken, a few of the hook and loop engagements at a time, and thus disengagement is readily accomplished.

The engagement between a hook and loop fastener is particularly strong in what may be called the shear direction. This direction is essentially perpendicular to the conventional face-to-face direction of engagement or disengagement of the mating fastener parts and requires a detachment force much greater than the progressive peeling force just described. In order to dislocate one fastener element with respect to the other in the shear direction, the totality of interengagements between hook and loop pile elements must be dislodged at once. Furthermore new interengagements of the hook and loop fastener elements continue in the sheer direction if these elements are dislocated in shear so that such interengagement is much more continuous than the face-to-face engagement.

SUMMARY OF THE INVENTION

The present invention provides attachments using hook and loop fasteners which rely upon the continued engagement of such fasteners elements in a shear direction in contrast to the normal face-to-face engaging direction of such elements. The term hook and loop fastener elements is meant to include various interengaged pile-like elements such as hook-to-loop; hook-to-hook; and different configurations of hook forms such as mushroom shapes, arrow and barbed shapes etc. all of which substantially mechanically interlock when brought into face-to-face engagement with one another and require a substantial force in such face-to-face direction to disengage the mechanical connections. A known type of shear connection is shown for example in U.S. Pat. No. Dritz 3,176,364 wherein as shown in FIG. 1, a male element having prongs or projections thereon is received within a passage provided with indentations for a connecting effect in shear with the prongs. This form of connection is also shown in U.S. Pat. No. 3,512,318 to Turner and it is hereby acknowledged that such connections are old.

It has been now discovered that conventional hook and loop pile fastener elements can be engaged by confining the hook and loop fastener elements in a manner such that engagement can only occur in the shear direction. Once engaged in this manner, the hook and loop fastener can be disengaged only in the shear direction as well, with consequent great increase in holding power.

In accordance with this principle various examples have been chosen and will be described in the following detailed specification in connection with the accompanying drawing.

BRIEF DESCRIPTION OF THE DRAWINGS

FIG. 1 is a perspective view of a window frame using the fastener attachment of the present invention;

FIG. 2 is a sectional view taken in the direction of arrows 2—2 of FIG. 1;

FIG. 3 is a sectional view similar to that of FIG. 2 showing an alternate form of window frame fastener;

FIG. 4 shows a generic form of attachment using the principle of the present invention;

FIG. 5 shows the attachment of the present invention for fastening box-like elements such as a television chassis within a television cabinet;

FIG. 6 is a quick connect/disconnect device according to the invention;

FIG. 7 is a particular form of quick connect/disconnect device;

DESCRIPTION OF PREFERRED EMBODIMENTS

Figure 8:
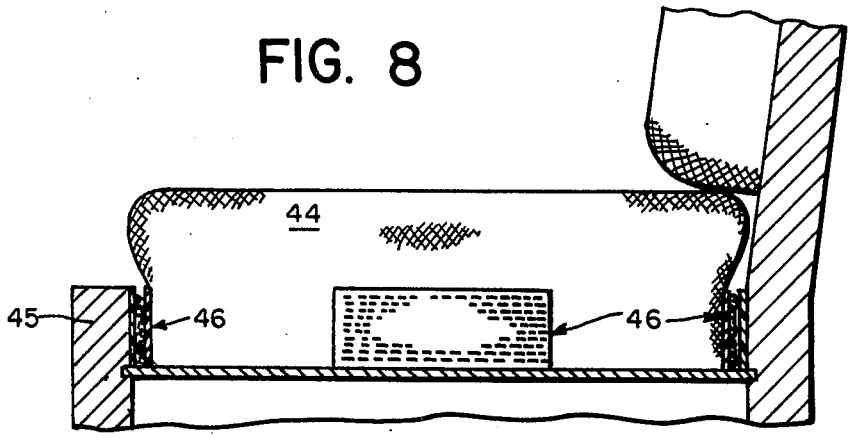
FIG. 8 shows the attachment of the present invention used to secure a cushion to a furniture base.

Referring now to the drawing and initially to FIGS. 1 and 2, the attachment of the present invention, as shown, is used to connect a window glass frame 10 to an adjacent mounting structure 11. The frame 10 consists of four L-shaped extruded members 12 secured at their corners to form the rectangular frame 10. Each extruded member 12 comprises legs **12*a* and 12*b***.

The structure 11 has attached thereto a permanent frame member 13 which is Z-shaped in cross section and is secured in a known manner to the adjacent structure 11 about an opening therein. The frame member 13 has legs **13*a*, 13*b*, and 13*c*. The member 12 is connected to glass retainer 15*a* which received the edge of a glass pane 15**.

In accordance with the principles of the present invention, a mating hook and loop fastener element 16 has a hook portion **16*a* secured to each leg 12*a* and loop portions 16*b* secured to the facing sides of legs 13*b*. The space between the opposing surfaces of legs 12*a* and 13*b* is sufficiently narrow so that the interengagement of the hooks of mating element 16*a* with the loops of element 16*b* is only possible in a shear direction. That is to say, the frame 10 must be forcefitted into the position shown with the hooks and loops being forced to engage each other in side-to-side relationship rather than in the normal face-to-face relationship. In order for this to occur, it will usually be necessary to drive the frame 10 into its assembled position within member 13** by using a rubber hammer for example.

In order to remove the frame 10 from its connection with the frame member 13, a tool such as a jimmy can be inserted in the space 17 between legs 12*b* and 13*c* of members 12 and 13 to progressively force the frame 10 out of its mounting in a shear direction with respect to the fastener elements 16*a* and 16*b*. Since disengagement of these elements is not possible in the normal manner, that is by progressively peeling one element from the other, such disengagement in the shear direction requires considerable force. The confinement of the hook and loop fastener elements by the spacing of the respective frame members 12 and 13 absolutely prevents any disengagement other than by shear disengagement and, as can be seen, interposition of a third member between the surfaces over at least a portion of the engagement area without physically destroying a substantial portion of engaged hooking elements in that area is thus precluded. Consequently, the frame 10 is at all times held very securely within frame member 13 and attachment and detachment of the frame 10 with respect to frame member 13 is achieved only by forces substantially parallel to the respective surfaces of the hook and loop fastener elements. Furthermore, the frame 10 is cushioned against shock by virtue of the hook and loop fastener element connection with frame member 13. It has been found that to engage and disengage the hook and loop fastener elements even fifty or sixty times will not seriously impair the function of the hook and loop fastener elements.

FIG. 3 discloses an arrangement similar to that of FIG. 2. In this embodiment, the structure 20 is attached to a Z-shaped frame 21 as before. A window glass retaining member 22 is of similar Z-shaped construction. Members 21 and 22 are joined to mating hook and loop fastener means 23, which again because of the narrow confining space between members 21 and 22, can only interengage or disengage in a shear direction. A window pane 24 is received along edge portions thereof by a plastic or rubber seal 26. Member 22 when force-fitted into engagement with frame member 21 will secure the window pane 24 in the position shown. Again, a space 27 is provided between the outer parts of members 21 and 22 to permit jimmying of the respective parts to effect disengagement.

FIG. 4 illustrates a generic form of shear hook and loop fastener attachment. A member 28, such as a removable panel for example, has one edge 28*a* disposed within a slot 29*a* in a permanent structure 29. Both the structure 29 and panel 28 have secured thereto mating portions of a hook and loop fastener 30. The width of the slot 29*a* is such that when the edge 28*a* of the panel 28 is within the slot, the distance from such edge 28*a* to the structure 29 wherein the hook and loop fastener is situated is only wide enough for normal interengagement of the hook and loop fastener elements. That is, it is impossible due to the confinement of the panel 28 within the slot to bring the hook and loop fastener elements into face-to-face engagement to achieve such interengagement. Rather, the panel 28 must be forced into the slot by forcing the hook and loop elements together in a shear direction. Disengagement must be similarly effected. Thus, the panel 28 will be held in the slot 29*a* much more securely than would otherwise result from normal face-to-face engagement of hook and loop fasteners.

FIG. 6 is similar in certain respects to the embodiment of FIG. 4 and illustrates the use of the present principles of attachment in a simple connector. The connector has a female element 31 and a male element 32, the latter having longitudinally disposed on its periphery a strip of hook fastener element 33. A mating strip of loop fastener element 34 is attached to the hollow cylindrical interior of the female member 31. It will be understood that the respective diameters of members 31 and 32 are very nearly the same allowing only a slight space for the hook and loop fastener parts 33 and 34 to interengage and disengage in a shear direction.

FIG. 7 shows a female member 36 and a male member 37 with loop pile material 38 connected all around the interior of the female member 36. Hook pile material 39 is disposed entirely about the periphery of the male member 37 and normal face-to-face engagement is impossible due to the narrow space provided. In this case, however, the hook pile elements 39 are constructed such that the hooks 39*a* are oriented all in the same directions; that is, the hook openings are disposed in a direction opposite to the direction of insertion. Consequently, when the member 37 is forced into the member 38 in shear, little resistance will be met, whereas withdrawing the member 37 from the member 38 is accomplished only against the considerable resistance of the hooks which are thus oriented against such withdrawal.

FIG. 5 illustrates a cabinet member 40 such as a television cabinet which receives a chassis 41. The fit of chassis into cabinet is close, allowing only a slight space for installation of hook fastener material 42 on the chassis and loop fastener material 43 along the facing interior of the cabinet. Consequently, the chassis must be force-fitted in shear within the cabinet, and removed against shear forces.

In FIG. 8, cushion 44 is attached to frame 45 by each part having about its periphery facing portions of hook and loop fastener elements 46. Here again, the spacing of cushion to frame is such that engagement of the hook and loop fasteners is solely in the shear direction.

Figure 9:
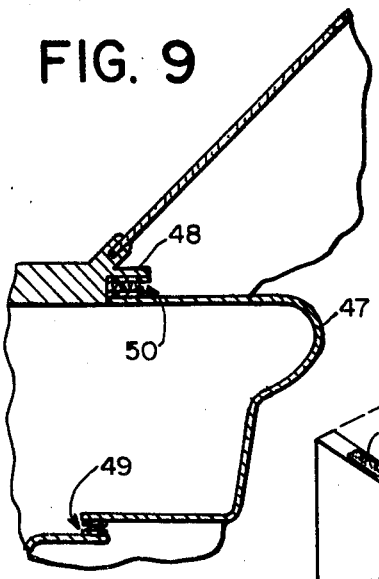
FIG. 9 shows the attachment of the invention securing an automobile dashboard in position.

In FIG. 9, similar interengagement of an automobile instrument panel 47 with a dashboard 48 is accomplished. Hook and loop fastener elements 49 and 50 are secured respectively to facing parts of the instrument panel and dashboard. The spacing of these two members is such that engagement and disengagement must occur only in the sheer direction.

Figure 10:
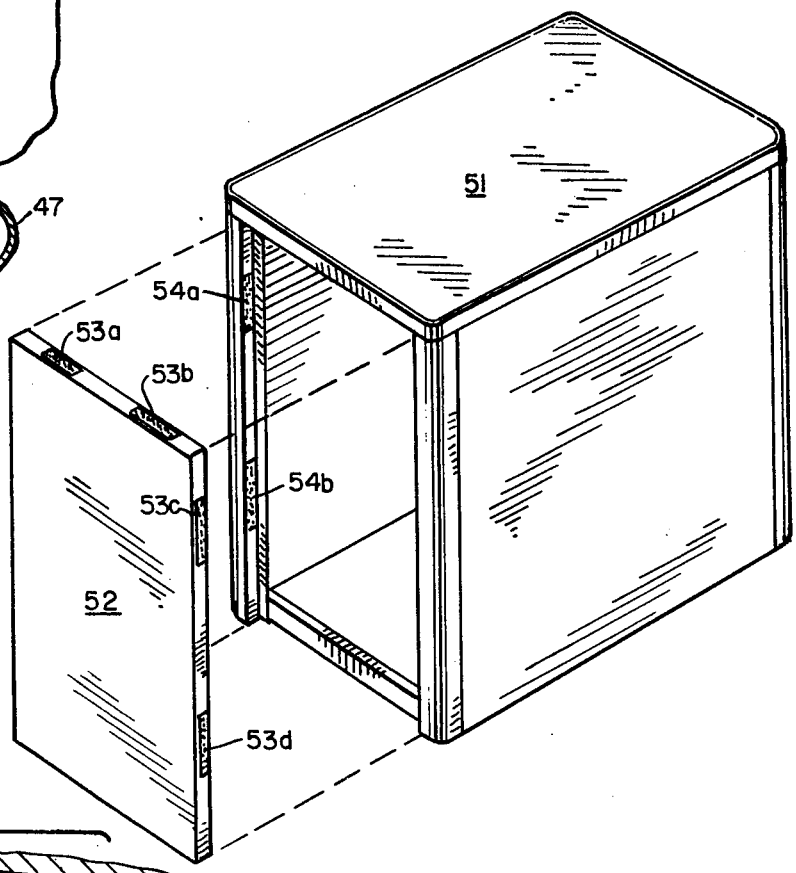
FIG. 10 discloses the use of such an attachment for fastening a panel in place.

FIG. 10 illustrates a container 51 having a removable panel or door 52. Spaced hook and loop fastener tape strips 53*a*, 53*b*, etc. are arranged about the periphery of the door 52 and mating strips 54*a*, 54*b*, etc. are arranged about the interior of receiving portions of the container 51. Engagement of the mating hook and loop fastener strips and disengagement thereof is in the shear direction.

Figure 11:
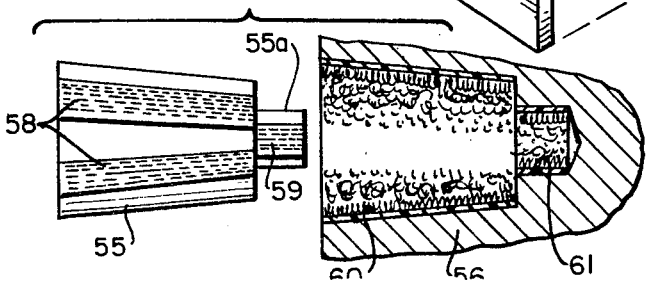
FIG. 11 shows the attachment of the present invention used in a space docking system.

FIG. 11 illustrates schematically forward portions of a space capsule 55 and a docking structure 56. The capsule 55 has strips of hook fastener element 58 arranged longitudinally on the conical forward portions thereof and strips 59 upon the straight cylindrical nose portion 55 *a* thereof. Docking station 56 is similarly equipped along its interior with mating hook fastener elements 60, 61 which will interengage in the shear direction when the forward end of the capsule 55 is thrust into the docking recess.

Figure 13:
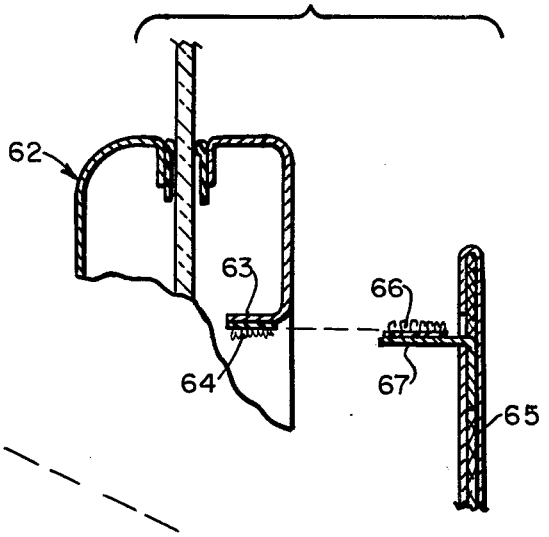
FIG. 13 is a sectional view taken in the direction of arrows 14—14 of FIG. 12.
Figure 12:
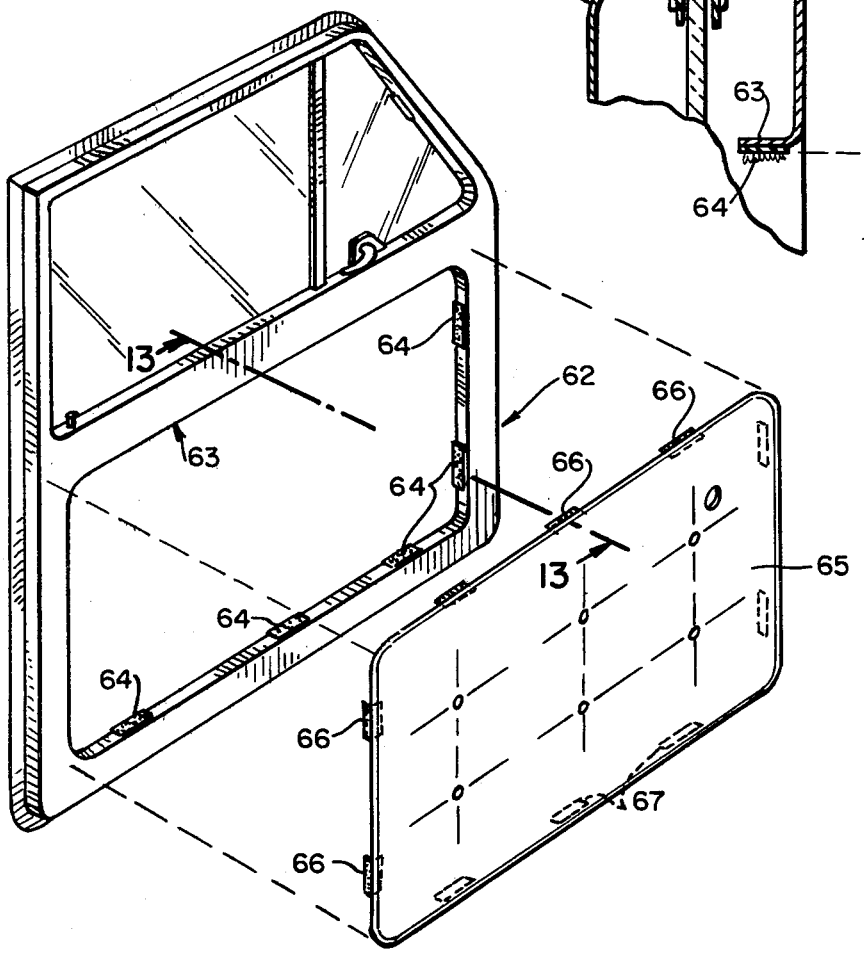
FIG. 12 shows the attachment of the invention used to install an automobile door panel.

In FIGS. 12 and 13 an automobile door 62 is provided with a panel opening 63, about the periphery of which are spaced strips of loop fastener material 64. A door panel 65 is equipped about its periphery with strips of hook fastener elements 66 arranged on metal supports 67 for the purpose. The peripheral dimension of the panel 65 is such that interengagement of the hook and loop fastener elements occurs only in a shear direction.

According to the principles of the present invention, a basically different form of attachment using hook and loop fasteners has been discovered. By forcing the hook and loop fastener elements of interengage and disengage only in a shear direction, beneficial use is made of the strength of such attachments in shear. The arrangement of adjacent parts is such that the hook and loop fastener elements are confined and cannot be peeled apart by way of normal disengagement. Such attachments will be able to replace conventional screw type connections for many purposes since the shear resistance to disconnection is very strong but can be accomplished readily by simply prying or forcefully overcoming the shear connection.

It will be understood that the above description has been of particular embodiments of the present invention and is, therefore, representative. In order to appreciate fully the scope of the present invention, reference should be made to the appended claims.

I claim:

1. A fastener including upstanding mating hooking elements of the hook-type and loop-type having the property that when a plurality of such hooking elements are placed in face-to-face relation with a plurality of mating hooking elements numerous engagements of the hooking elements take place and the elements resist separation by forces substantially parallel to the interfacial plane of engagement, comprising:

(a) at least first and second fastener members, each having at least one surface containing hooking elements capable of mating with the hooking elements of the other; and (b) substantially rigid structural members secured to said fastener members for positioning said fastener members such that said surfaces are maintained in substantially rigid parallel relation and confined in a substantially fixed spaced relationship, which space is sufficiently less than the combined height of the hooking elements upstanding from both surfaces such that at least certain of the hooking elements are brought into a hook and loop-type engaged relation by forcibly directing the hooking elements of at least one of said fastener members in a direction generally normal to the projection of said hooking elements such that interposition of a third member between said surfaces over at least a portion of the engagement area of said hooking elements without physically destroying a substantial portion of the engaged hooking elements in said area is thereby precluded, such that relative movement of the fastener members is confined generally along the direction perpendicular to the projection of said hooking elements, and attachment and detachment of the respective members is achieved only by forces substantially parallel to the respective surfaces of said fastener members in sufficient magnitude to overcome the progressive resistance of the hooking elements progressively engaging and disengaging as they are moved relative to each other.

2. The fastener according to claim 1 wherein said surfaces are substantially flat.

3. The fastener according to claim 2 wherein one of said structural members is configured to substantially surround at least a portion of the second structural member thereby creating the confinement of relative movement of said members and the progressive resistance of said hooking elements when said members are moved relative to each other.

4. The fastener according to claim 15 wherein said hooking elements are disposed on opposed surfaces of said structural members in the form of fastener tapes secured thereto, said tapes having said hooking elements extending upwardly from a surface thereof.

5. The fastener according to claim 4 wherein at least one surface of one of said members contains hooking elements in the form of hooks and the mating surface of the other member contains hooking elements in the form of loops.

6. The fastener according to claim 1 wherein said members are respectively an outer stationary frame and an inner removable frame and said hooking elements are positioned on at least one outer surface of said inner frame and a corresponding inner surface of said outer frame.

7. The fastener according to claim 1 wherein one of said members defines a female slot having inwardly facing surfaces configured to receive at least a portion of the second member in the form of a male member, said hooking elements being disposed on the inwardly facing surfaces of the female slot and the corresponding outwardly facing surfaces of at least one side portion of the male member.

8. The fastener according to claim 1 wherein the first member comprises a hollow cylindrical member having a cylindrical inner surface with hooking elements upstanding from the inner surface thereof and the second member comprises a tubular member of lesser outside radius than the inside radius of said cylindrical member and having mating hooking elements upstanding from the outer surface thereof, the difference in the radii of said members being less than the combined height of the hooking elements on each surface such that attachment and detachment of the members is achieved by forces substantially parallel to the axes of the members in sufficient magnitude to overcome the progressive resistance of the hooking elements with the result that during attachment of the members numerous repeated attachments and detachments of the hooking elements take place while during separation of the members repeated detachments and attachments of the hooking elements take place.

9. The fastener according to claim 13 wherein one of said members is a cabinet defining an opening having opposing sides to receive the other of said members in the form of a closure for said opening.

10. The fastener according to claim 13 wherein at least portions of the surfaces of said members containing hooking elements are conical.

11. The fastener according to claim 13 wherein one of said members is a vehicular dashboard and the other is an instrument panel.

12. The fastener according to claim 20 wherein one of said cylindrical tubular members mounts at least one fastener tape containing hooking elements in the form of loops and the other mounts at least one fastener tape containing hooking elements in the form of hooks, all of the hooks of said hook fastener tape being oriented in a direction to resist disengagement after the tubular member is received within said cylindrical member due to the progressive interference shear resistance of said hooks and loops.

13. A fastener including upstanding mating hooking elements of the hook-type and loop-type having the property that when a plurality of such hooking elements are placed in face-to-face relation with a plurality of mating hooking elements numerous engagements of the hooking elements take place and the elements resist separation by forces substantially parallel to the interfacial plane of engagement, comprising:

(a) at least first and second fastener tapes each having at least one surface having a plurality of hooking elements upstanding therefrom and defining a respective mating surface; and (b) substantially rigid structural members secured to said fastener tapes for positioning said fastener tapes such that the mating surfaces of said fastener tapes are maintained in substantially rigid parallel relation and confined in a substantially fixed spaced relationship, which space is sufficiently less than the combined height of the hooking elements upstanding from both surfaces of said tapes such that at least certain of the hooking elements are brought into a hook and loop-type engaged relation by forcibly directing the hooking elements of at least one of said fastener tapes in a direction generally normal to the projection of said hooking elements such that interposition of a third member between said fastener tapes over at least a portion of the engagement area of said hooking elements without physically destroying a substantial portion of the engaged hooking elements in said area is thereby precluded, such that relative movement of the members is physically confined generally along the direction normal to the projection of said hooking elements, and attachment and detachment of the respective members is achieved only by forces substantially parallel to the respective mating surfaces of said fastener tapes in sufficient magnitude to overcome the progressive resistance of the hooking elements progressively engaging and disengaging as the structural members are moved relative to each other.

* * * * *

UNITED STATES PATENT AND TRADEMARK OFFICE

CERTIFICATE OF CORRECTION

PATENT NO. : 4,271,566

DATED : June 9, 1981

INVENTOR(S) : Joseph Perina

It is certified that error appears in the above-identified patent and that said Letters Patent are hereby corrected as shown below:

Claim 4, column 6, line 4, "15" should read --3--;

Claim 9, column 6, line 47, "13" should read --1--;

Claim 10, column 6, line 51, "13" should read --1--; and

Claim 12, column 6, line 57, "20" should read --8--.

Signed and Sealed this

*Eighth* Day of *September 1981*

[SEAL]

*Attest:*

GERALD J. MOSSINGHOFF

*Attesting Officer*

*Commissioner of Patents and Trademarks*